US008562293B2

(12) United States Patent
Engländer

(10) Patent No.: US 8,562,293 B2
(45) Date of Patent: Oct. 22, 2013

(54) MULTI-STAGE PUMP ROTOR FOR A TURBOMOLECULAR PUMP

(75) Inventor: Heinrich Engländer, Linnich (DE)

(73) Assignee: Oerlikon Leybold Vacuum GmbH, Cologne (DE)

( * ) Notice: Subject to any disclaimer, the term of this patent is extended or adjusted under 35 U.S.C. 154(b) by 777 days.

(21) Appl. No.: 12/682,067

(22) PCT Filed: Sep. 19, 2008

(86) PCT No.: PCT/EP2008/062519
§ 371 (c)(1),
(2), (4) Date: May 25, 2010

(87) PCT Pub. No.: WO2009/049988
PCT Pub. Date: Apr. 23, 2009

(65) Prior Publication Data

US 2010/0290915 A1 Nov. 18, 2010

(30) Foreign Application Priority Data

Oct. 11, 2007 (DE) ..... 10 2007 048 703

(51) Int. Cl.
*F04D 19/04* (2006.01)

(52) U.S. Cl.
USPC ..... 415/199.5; 415/229

(58) Field of Classification Search
USPC ..... 415/90, 229, 230, 199.5; 416/4, 230, 416/241 A, 55.1
See application file for complete search history.

(56) References Cited

U.S. PATENT DOCUMENTS

| | | | | |
|---|---|---|---|---|
| 3,032,260 | A * | 5/1962 | Latham | 415/190 |
| 4,312,628 | A * | 1/1982 | Yamamura | 417/423.4 |
| 6,454,525 | B2 | 9/2002 | Blecker et al. | |
| 2005/0013710 | A1 | 1/2005 | Stanzel | |

FOREIGN PATENT DOCUMENTS

| | | | |
|---|---|---|---|
| EP | 1130269 | A2 | 9/2001 |
| EP | 1498612 | A2 | 1/2005 |
| EP | 1850011 | A2 | 10/2007 |
| JP | 59093993 | A | 5/1984 |
| JP | 60203375 | A | 10/1985 |
| JP | 61038194 | A | 2/1986 |
| JP | 2005180265 | * | 7/2005 |
| JP | 2005180265 | A | 7/2005 |
| WO | 2010015847 | A1 | 2/2010 |

* cited by examiner

*Primary Examiner* — Ninh H Nguyen
(74) *Attorney, Agent, or Firm* — Fay Sharpe LLP

(57) ABSTRACT

A multi-stage pump rotor (10) for a turbomolecular pump has at least two separate blade disk rings (17), each having a motor ring (12) and at least one blade disk (14). A cylindrical reinforcement pipe (18), which surrounds the rotor rings (12) of the blade disk rings (17) on the outside without clearance, is provided between the blade disks (14) of adjacent blade disk rings (17). The reinforcement pipe (18) absorbs a large part of the tangential forces occurring during operation such that the pump rotor (10) has improved stability at high rotor speeds.

15 Claims, 2 Drawing Sheets

MULTI-STAGE PUMP ROTOR FOR A TURBOMOLECULAR PUMP

BACKGROUND

The invention relates to a multi-stage pump rotor of a turbomolecular pump.

Turbomolecular pumps according to the state of the art are operated at rotational speeds of several 10,000 r/min. In relatively large turbomolecular pumps, the kinetic energy of a pump rotor operated at such a nominal rotational speed is in the range of the kinetic energy of a compact car at a velocity of 50 to 70 km/h. In case of a rotor burst, this high kinetic energy will cause a massive potential of destruction and injury which can be kept under control only by considerable expenditure for the mechanical shielding of the rotor.

Particularly cantilevered pump rotors for turbomolecular pumps that are magnetically supported, will be problematic with regard to their susceptibility to bursting. In magnetically supported pump rotors of the cantilevered type, designers will aim to arrange at least one radial bearing and the drive motor in the region of the center of gravity of the pump rotor. For this purpose, it is required that the pump rotor is of a bell-shaped configuration so that the magnetic bearing and optionally also the drive motor CaO be accommodated in the bell cavity within the pump rotor. Said bell-shaped configuration of the pump rotor will entail a design-inherent weakening of the rotor. In pump rotors of turbomolecular pumps, being normally formed as a one-part unit, this design-inherent weakening can be compensated for only by use of highly resistant aluminum alloys which are extremely expensive.

SUMMARY

It is an object of the invention to provide a multi-stage pump rotor for turbomolecular pumps which has improved stability.

The pump rotor of the invention is not designed as a one-part unit anymore and comprises at least two separate blade disk rings, each of them having at least one rotor ring and at least one blade disk. The ends of the two rotor rings of adjacent blade disk rings are on the outside surrounded, without clearance, by a cylindrical reinforcement pipe which is arranged between the adjacent blade disks of the adjacent rotor disk rings. Said reinforcement pipe does not necessarily serve for axial and radial fixation of the two rotor rings relative to each other; however, it encloses the two rotor rings so tightly that it will take up at least a part of the tangential forces generated by the centrifugal forces in the rotor ring and thus will mechanically relieve the rotor rings.

The pump rotor is not a one-part unit anymore but is of a multi-part design. The pump rotor can be formed of a plurality of rotor rings having respectively a sole blade disk. Even if a rotor ring should tangentially break under the effect of large centrifugal forces, such breakage would be locally restricted to the respective rotor ring and would not have the chance to easily spread onto the entire pump rotor.

By the axial segmentation of the pump rotor and by the use of a reinforcement pipe enclosing the rotor rings and taking up tangential forces, it is accomplished that, on the one hand, the danger of a pump-rotor burst is considerably reduced and that, on the other hand, in case of a rotor ring bursting, the accompanying destructive forces and the resultant dangers to operator and equipment will be considerably diminished.

By the use of a plurality of rotor rings and because of the reinforcement pipes, the respective component parts can be designed in a well-aimed manner tailored to their intended function. Thereby, it is rendered possible to optimize both the rotor ring and the reinforcement pipe with regard to their function, i.e., on the one hand, carrying the rotor blades and, on the other hand, taking up the tangential forces. The rotor ring can be made e.g. of inexpensive and fairly pull-resistant aluminum alloys or other materials. For the reinforcement pipe, however, a material is selected which is able to take up high pulling forces.

Even in large-sized turbomolecular pumps, as evidenced by tests and calculations performed on one-part pump rotors, the stress caused by centrifugal forces in the rotor blades is not the factor that will delimit the rotational speed. Thus, the blades themselves allow for a higher rotational speed. Upon occurrence of a burst of the bell-shaped pump rotor, the cracks will extend substantially in axial direction so that, in this manner, larger rotor fragments will be generated. The entire rotational energy of the rotor will then be released in a projectile-like manner within a very short time.

In case of a burst of an individual blade disk ring of a multi-part rotor, the resultant projectiles will be considerably smaller and the deceleration of the rotor due to the contact of the respective blade disk ring with the stator will be considerably slower than in case of a burst of a one-part pump rotor.

By forming the pump rotor from individual blade disk rings, the blade disk and respectively the rotor blades can be manufactured more easily under the aspect of production technology, and they can be given more-complex shapes. In situations of higher pressures within the turbomolecular pump containing the pump rotor, this can lead to an improvement of the flow mechanics in the pump stages.

By the use of a relatively lighter material for the reinforcement pipe, the total weight of the pump rotor can be reduced.

The blade disk ring can be—but does not necessarily have to be—formed as a one-part unit. Alternatively, the blade disk ring can be composed of a plurality of segments. If the rotor ring has been subdivided into a plurality of segments, virtually no tangential forces will occur anymore in the rotor ring and such forces will be transferred exclusively into the reinforcement pipe.

Preferably, however, the blade disk ring is formed as one part. This closed one-part blade disk ring can be more easily produced and mounted.

Preferably, the material of the reinforcement pipe is different from the material of the blade disk rings. The preferred material used for the reinforcement pipe is CFK, i.e. carbon-fiber-reinforced plastic which is suited as a material for the reinforcement pipe particularly because of its ability to take up high tensile forces and because of its low weight.

According to a preferred embodiment, at least one rotor blade disk comprises a sole blade disk consisting of rotor blades. By delimiting the rotor ring or rotor rings to a sole blade disk, it is made possible to arrange a respective reinforcement pipe between each blade disk pair of mutually adjacent blade disks. Obtained in this manner is a maximum of stability of the pump rotor with regard to the tangential forces. It is, however, not necessary that all blade disk rings of the pump rotor comprise only one blade disk. Thus, for instance, in the region of the pump rotor where especially high tangential forces occur, blade disk rings comprising only one blade disk can be provided, whereas, in other axial regions of the pump rotor where lower tangential forces occur or where the rotor ring can be designed with increased radial strength, the respective blade disk ring can also comprise two or more blade disks.

Preferably, the blade disk rings are axially clamped to each other between two rotor-shaft clamping bodies. The rotor rings can rest on each other in a self-centering manner, e.g.

with the aid of corresponding axial annular grooves and annular bars, and be correspondingly axially clamped to each other by said two rotor-shaft clamping bodies. Alternatively, or additionally, also at least one rotor support body can be provided for mounting the rotor rings of the blade disk rings thereon. Such rotor support bodies can form said clamping bodies; however, the clamping bodies can also be formed separately from the rotor support bodies carrying the rotor rings.

The rotor support body can be made of a material different from that of the rotor rings or the reinforcement pipes.

With preference, the pump rotor includes a cavity for accommodation of a rotor bearing which preferably is a magnetic bearing. In magnetically supported turbomolecular-pump rotors of the cantilevered type, an effort will be made, as already detailed above, to arrange a radial bearing and the drive motor in the vicinity of the center of gravity of the pump rotor. For this purpose, a corresponding cavity in the pump rotor will be indispensible, with the consequence that the pump rotor is given a bell-shaped configuration. Especially in magnetically supported pump rotors of turbomolecular pumps, said axial segmentation of the pump rotor into individual rotor rings is particularly advantageous because, due to the restriction of the constructional space of the pump rotor, it is particularly the cavity portion of the pump rotor which will be subjected to large tangential stresses.

Still further advantages of the present invention will be appreciated to those of ordinary skill in the art upon reading and understand the following detailed description.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

In the drawings, the following is shown.

DETAILED DESCRIPTION

Figure 1:
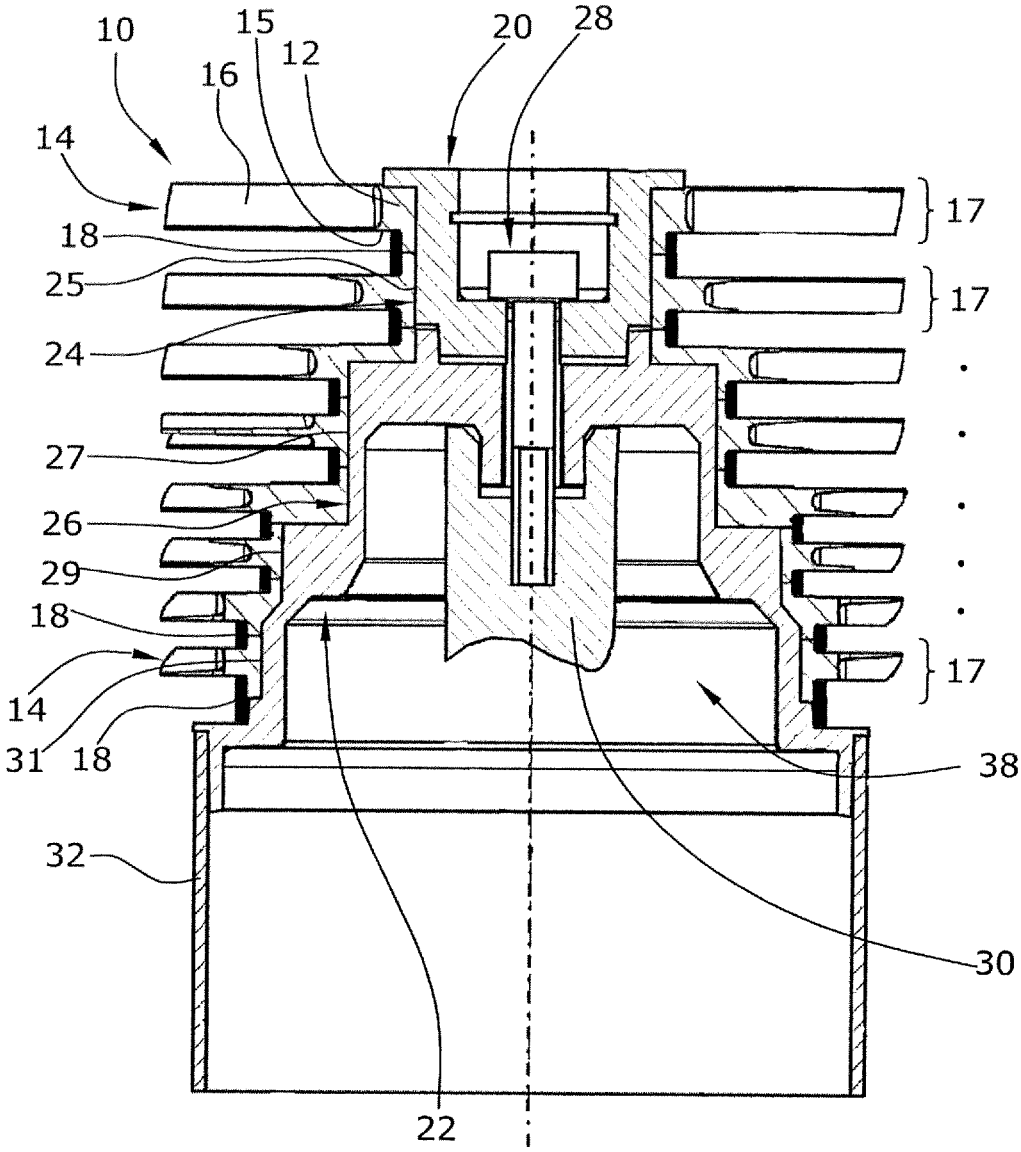
FIG. 1 illustrates a first embodiment of a multi-stage pump rotor of a turbomolecular pump, comprising rotor support bodies of the one-component type.
Figure 2:
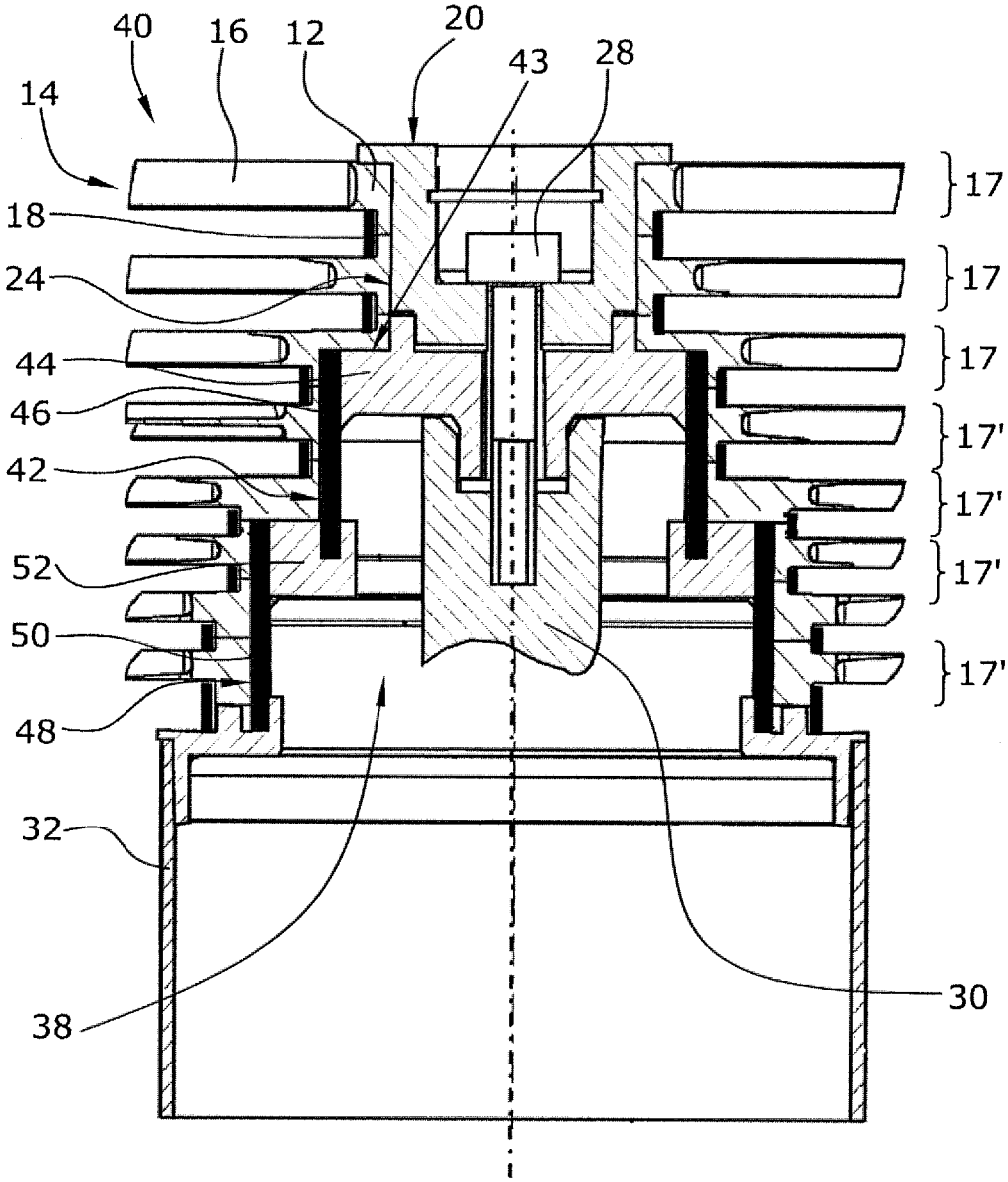
FIG. 2 illustrates a second embodiment of a pump rotor of a turbomolecular pump, comprising rotor support bodies of the two-component type.

In FIGS. 1 and 2, there is illustrated respectively a multi-stage pump rotor 10; 40 for a turbomolecular pump. Said pump rotor 10; 40 is adapted to rotate at nominal rotational speeds from 20,000 to 100,000 r/min. The two pump rotors 10; 40 are substantially of identical design and differ from each other only with regard to their inner configuration.

Pump rotor 10 according to FIG. 1 is formed substantially of eight blade disk rings 17 which are axially clamped to each other with the aid of two clamping bodies 20,22 which themselves are axially clamped to each other by a clamping screw 28 and a shaft 30. Further, said blade disk rings 17 are followed by a rotor-side Holweck cylinder 32.

Pump rotor 10 is not designed as a one-part unit as commonly the case in pump rotors of the state of the art, but is composed of a plurality of blade disk rings 17. Each blade disk ring 17 is formed by a closed rotor ring 12 having rotor blades 16 extending therefrom in radially outward directions, said rotor blades 16 in turn forming a blade disk 14.

Said rotor rings 12 are axially held together with the aid of said two axial clamping bodies 20,22 axially clamped to each other by clamping screw 28 and shaft 30. Further, the two clamping bodies 20,22 form respective outer-cylindrical rotor support bodies 24,26 on whose support cylinders 25,27, 29, 31 the respective rotor rings 12 are mounted. Said rotor support bodies 24,26 serve for radial positioning and respectively fixation of the rotor rings 12. The one-pieced clamping body 22 arranged on the outlet side is of a triple-stepped shape and comprises three support cylinders 27,29,31. The rotor rings 12 are seated, with a slight clamping force and without clearance, on said rotor support bodies 24,26 and respectively on the support cylinders 25,27,29,31 thereof.

Said clamping screw 28 is effective to hold the rotor shaft 30, the pressure-side rotor support body 26 and the inlet-side rotor support body 24 axially clamped to each other.

Each rotor ring 12 comprises an axial shoulder 15 on one or both of its axial ends. In the region of the shoulders 15 of adjacent rotor rings 12, a respective reinforcement pipe 18 made of glass-fiber-reinforced plastic (CFK), is axially mounted with a biasing force. During rotation of pump rotor 10, the reinforcement pipes 18 will substantially take up the tangential forces generated by the centrifugal force in rotor ring 12. As a result, it is possible to use relatively inexpensive aluminum alloys as a material of the one-part blade disk rings 17.

The pressure-side rotor support body 26 is internally provided with a cavity 38 offering sufficient space for placement of a rotor bearing of rotor shaft 30, said rotor bearing preferably being a magnetic bearing.

As depicted in FIGS. 1 and 2, the pressure-side end of rotor support body 26 can be followed by a Holweck cylinder 32.

As compared with the above pump rotor 10 according to FIG. 1, the pump rotor 40 according to FIG. 2 is different only with regard to the configuration of the rotor support bodies and the clamping bodies. In this embodiment, a total of three rotor support bodies 24,42,48 are provided. The inlet-side rotor support body 24 together with the intermediate rotor support body 42 forms two clamping bodies 20,43 which are axially clamped to each other by the three inlet-side blade disk rings 17. The other blade disk rings 17' are not axially clamped to each other but are axially fixed to each other by other constructive measures.

Said intermediate rotor support body 42 as well as the pressure-side rotor support body 48 are each of a two-part design and each includes a disk body 44,52 and a cylindrical support cylinder 46,50. Each disk body 44,52 is made of aluminum, and each support cylinder 46,50 is made of carbon-fiber reinforced plastic.

The two-component design of the two rotor support bodies 42,48 allows for a further reduction of the mass of rotor 40, thus reducing the kinetic rotational energy, which in turn has the consequence that less energy will be released in case of a rotor burst and that, because of the reduced centrifugal forces, higher rotational speeds can be realized.

The invention has been described with reference to the preferred embodiments. Modifications and alterations may occur to others upon reading and understanding the preceding detailed description. It is intended that the invention be construed as including all such modifications and alterations insofar as they come within the scope of the appended claims or the equivalents thereof.

The invention claimed is:

1. A multi-stage pump rotor for a turbomolecular pump, said pump rotor comprising:

at least two separate blade disk ring elements respectively having a rotor ring and at least one blade disk, and a cylindrical reinforcement pipe arranged between the blade disks of adjacent blade disk ring elements and enclosing the rotor rings of the blade disk rings on the outside without clearance.

2. The multi-stage pump rotor for a turbomolecular pump according to claim 1, wherein the material of the reinforcement pipe is different from that of the blade disk rings.

3. The multi-stage pump rotor for a turbomolecular pump according to claim 1, wherein the material of the reinforcement pipe is carbon-fiber-reinforced plastic.

4. The multi-stage pump rotor for a turbomolecular pump according to claim 1, wherein at least one blade disk ring consists of a sole blade disk.

5. The multi-stage pump rotor for a turbomolecular pump according to claim 1, wherein the rotor rings rest on each other and are axially clamped in a direct abutting relationship with each other between two rotor-shaft clamping bodies.

6. The multi-stage pump rotor for a turbomoledcular pump according to claim 5, wherein the abutting rotor rings define cylindrical outer surfaces, and the cylindrical reinforcement pipe has a cylindrical inner surface which engages the cylindrical outer surfaces of the abutting rotor rings without clearance.

7. The multi-stage pump rotor for a turbomolecular pump according to claim 1, wherein the rotor rings of the blade disk ring elements are mounted surrounding at least one rotor support body.

8. The multi-stage pump rotor for a turbomolecular pump according to claim 7, wherein the rotor support body is made at least partially of carbon-fiber-reinforced plastic.

9. The multi-stage pump rotor for a turbomolecular pump according to claim 7, wherein the rotor support body defines a cavity for accommodation of a rotor bearing.

10. The multi-stage pump rotor for a turbomolecular pump according to claim 7, further comprising a rotor bearing, wherein said rotor bearing is a magnetic bearing.

11. The multi-stage pump rotor for a turbomolecular pump, the pump rotor including:

at least two separate blade disk ring assemblies, each having a rotor ring and a blade disk;

a rotor support body on which the blade disk ring assemblies are mounted with the rotor rings directly abutting each other;

a cylindrical reinforcement pipe arranged between the blade disks of adjacent blade disk ring assemblies with abutting rotor rings and encircling the abutting rotor rings of the blade disk ring assemblies on a cylindrical outside surface of the abutting rotor rings without clearance such that the reinforcement pipes take up tangential forces generated by centrifugal force in the abutting rotor rings during rotation of the pump rotor.

12. The multi-stage pump rotor for a turbomolecular pump according to claim 11, wherein:

the rotor support body is made at least partially of fiber-reinforced plastic.

13. The multi-stage pump rotor for a turbomolecular pump according to claim 11, wherein the rotor rings are axially clamped between two rotor-shaft clamping bodies in a self-centering manner.

14. The multi-stage pump rotor for a turbomolecular pump according to claim 11, wherein the reinforcement pipe is constructed of fiber-reinforced plastic.

15. The multi-stage pump rotor for a turbomolecular pump according to claim 11, wherein the rotor support body includes a fiber-reinforced plastic cylinder with an outer diameter that matches an inner diameter of the rotor rings such that the rotor rings are supported on and encircling the fiber-reinforced cylinder.

* * * * *

UNITED STATES PATENT AND TRADEMARK OFFICE

CERTIFICATE OF CORRECTION

PATENT NO. : 8,562,293 B2
APPLICATION NO. : 12/682067
DATED : October 22, 2013
INVENTOR(S) : Heinrich Engländer It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 820 days.

Signed and Sealed this
Fifteenth Day of September, 2015

Michelle K. Lee

Michelle K. Lee
*Director of the United States Patent and Trademark Office*